United States Patent [19]

Padula et al.

[11] 3,996,857

[45] Dec. 14, 1976

[54] JUNGLE PENETRATION MUNITION

[75] Inventors: William V. Padula, Cranford; William Serensen, Jr., North Brunswick, both of N.J.

[73] Assignee: The United States of America as represented by the Secretary of the Army, Washington, D.C.

[22] Filed: May 10, 1972

[21] Appl. No.: 251,983

[52] U.S. Cl. ..... 102/7.2; 102/79

[51] Int. Cl.[2] ..... F42B 25/22

[58] Field of Search ..... 102/79, 7.2, 63, 87

[56] References Cited

UNITED STATES PATENTS

| | | | |
|---|---|---|---|
| 1,235,637 | 8/1917 | Barlow | 102/7.2 |
| 1,382,750 | 6/1921 | Sprague | 102/7.2 |
| 1,791,716 | 2/1931 | Davis et al. | 102/7.2 X |
| 2,449,540 | 9/1948 | Albin | 102/7.2 X |
| 2,962,968 | 12/1960 | Neuwirth, Jr. et al. | 102/79 X |
| 3,344,742 | 10/1967 | Schneider, Jr. | 102/7.2 |

*Primary Examiner*—David H. Brown

*Attorney, Agent, or Firm*—Nathan Edelberg; A. Victor Erkkila; Thomas R. Webb

[57] ABSTRACT

A jungle penetration munition is produced which will pierce thick jungle foliage and function approximately six feet above the jungle floor.

14 Claims, 1 Drawing Figure

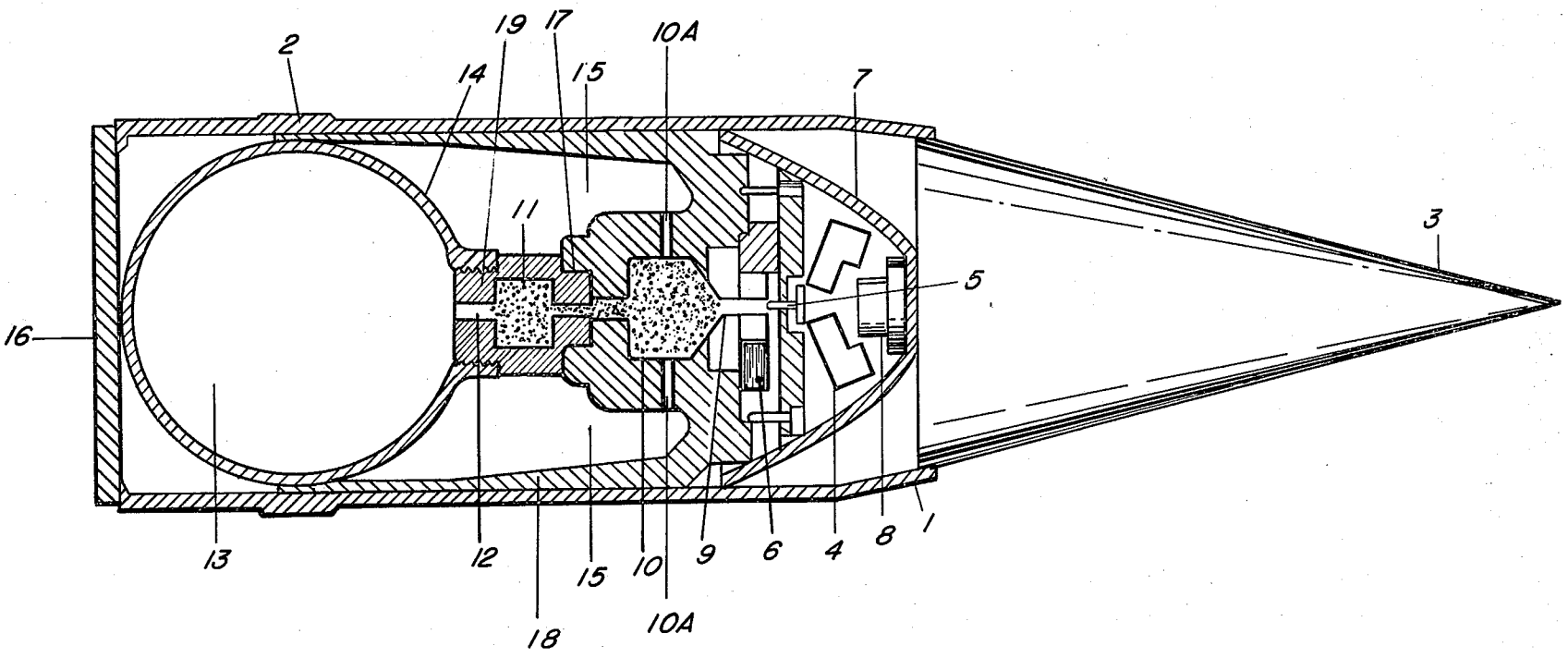
3
5
7
2
14
19
17
15
10A
16
13
11
12
18
15
10
10A
9
6
4
8
1

JUNGLE PENETRATION MUNITION

The invention described herein may be manufactured, used and licensed by or for the Government for governmental purposes without the payment to us of any royalty thereon.

BACKGROUND OF THE INVENTION

Requirements for jungle warfare have dictated the development of an air-delivered munition capable of piercing thick jungle foliage and thereafter functioning as an anti-personnel weapon. The present invention provides both of these capabilities while furnishing a munition which is simple in both construction and operation.

More particularly the present invention consists of a munition capable of being air dropped and upon impact with the ground operates to propel an anti-personnel explosive device approximately six feet above the ground where the device will explode, inflicting casualties on personnel in the area.

It is therefore an object of this invention to provide a munition having a configuration which will enable it to penetrate thick jungle foliage.

Yet another object is to provide a munition which will explode approximately six feet above the ground, scattering metal fragments over a large area.

Other objects and many of the attendant advantages of this invention will be readily appreciated as the same become better understood by reference to the following detailed description.

DESCRIPTION OF THE INVENTION

Our invention consists of a projectile with conical nose section enabling penetration, upon delivery of the projectile, of the thickest foliage and an explosively detachable anti-personnel munition within the projectile which activates upon impact with the ground.

The drawing provided with the specification represents a longitudinal cross section of such a projectile and enclosed munition.

Referring more particularly to the drawing, the projectile includes a cylindrical shell 1 with a rotating band 2, a rear cover 16 and a conical ogive 3. The fuze assembly in the projectile consists of centrifugal weights 4 held inwardly between the firing pin and anvil by spring tension, a biased firing pin 5, a biased fuze detonator 6 (shown in a "safe" out-of-line position), a collapsible casing 7 and an anvil 8. Adjacent the fuze assembly, in seriatim, are the firing train 9, separating charge 10, delay detonator 11 and the detonator 12 for the explosive device consisting of a spheroid shaped metal housing 14 containing high explosive 13. The metal housing 14 may also be elliptical or cylindrical in shape and is attached by screw threads to a cylindrical plug 19 which is provided with an axial channel (shown but not enumerated) containing the delay detonator 11 and the spheroid charge detonator 12. The cylindrical plug 19 is provided with a boss (shown but not enumerated) which is releasably held, e.g. press fitted, in recess 17 of main casing 18 which fits tightly within the projectile shell 1. Casing 18 has an open end facing the rear of the projectile and a base at its other end having an axial passage, which communicates with firing train 9 and delay detonator 11 and contains separating charge 10. The base of main casing 18 is provided with radial channels 10A connecting the separating charge 10 with closed chamber 15, which is formed by fitting spheroid housing 14 tightly to the inner wall of cylindrical casing 18. This enables the explosive device, consisting of housing 14 containing explosive charge 13, together with attached explosive charge detonator 12 and delay detonator 11 (hereinafter characterized as the antipersonnel munition) to be ejected from the projectile along with the crimped cover 16 of the projectile by gas pressure buildup in chamber 15 resulting from explosion of separating charge 10.

Describing the invention in terms of composition and structure, the cartridge shell 1 is fabricated of a metal, preferably aluminum or a steel alloy. The conical ogive 3 is composed of a metal, such as aluminum or steel alloy, and may be hollow, partially hollow or preferably honeycombed in structure.

In the fuze assembly the centrifugal weights 4 may be any suitable material such as steel or lead. The collapsible casing 7 is made of aluminum or plastic or other suitable material. The anvil 8 is constructed of a hard material, such as brass, steel alloy or quartz. The fuze detonator 6 is an explosive, possessing extreme sensitivity, such as lead azide, lead styphnate or hexanitromannite.

The firing train 9 is generally composed of a compressed column of either OCTOL (70% cyclotetramethylene tetranitramine and 30% black powder), black powder or a pyrotechnic mixture of an oxidant and a metallic fuel. The separating charge 10 consists of a gas-producing explosive mixture such as M9 propellant [57.75% nitrocellulose (13.25% N), 40% nitroglycerin, 1.50% potassium nitrate and 0.75 % diphenylamine] or black powder.

The expellable anti-personnel munition, as stated before, consists of a delay detonator 11, a spheroid charge detonator 12 and an explosive device.

The explosive device comprises a hard, frangible metal jacket 14 surrounding a high explosive 13. The metal is quilted to provide uniform particle breakup. Metals such as brass and steel alloy are preferred. High explosives suitable as the explosive include RDX (cyclotrimethylene trinitramine) and HMX (cyclotetramethylene tetranitramine). The delay detonator 11 consists of black powder or pyrotechnic material which transmits fire to the detonator 12. A particularly effective delay detonator composition consists of a mixture of RDX (cyclotrimethylenetrinitramine), lead azide and a mixture of iron oxide, zirconium and silicon dioxide. The detonator 12 is a highly sensitive explosive such as lead azide or lead styphnate, a particularly effective detonator consisting of a mixture of RDX and lead azide together with a booster charge of 2,4,6, trinitrophenyl methyl nitramine.

In operation the projectile may be fired from a launcher, mortar, helicopter or fixed-wing aircraft. The rotating band 2 upon firing from existing weapons establishes the required spin to arm the fuze. Upon attaining a pre-chosen spin velocity, the centrifugal weights 4, which held the firing pin 5 in a biased position, overcome the spring tension which held them in place and move out, allowing the spring actuated firing pin 5 to move closer to but not in contact with the anvil 8. This in turn frees the detonator 6 which was held in an out-of-line position by the firing pin. As the firing pin moves toward the anvil, it releases the detonator 6 which rotates from its out of line "safe" position into a position directly between the firing pin and firing train 9 by means of spring actuation. This completes the in-flight arming of the fuze.

Upon striking the ground the ogive 3 and the collapsible casing 7 are crushed thus forcing the anvil 8 to contact the firing pin 5, initiating the detonator 6 and igniting the firing train 9. Thereafter the firing train ignites the separating charge 10 which (1) expels gases through channels 10A into the chamber 15, said gases blowing off the crimped end 16 of the projectile and expelling the anti-personnel munition approximately 6 feet into the air and (2) ignites the delay detonator 11. The delay detonator 11 activates detonator 12 when the munition has reached its approximate six foot height causing the detonation of the explosive 13 and the bursting of the metal casing 14 into fragments.

Thusly, through the practice of our invention, a projectile and munition is provided which because of its configuration can penetrate thick foliage and yet maintain an anti-personnel capability.

We wish it to be understood that we do not desire to be limited to the exact detail of construction shown and described for obvious modification will occur to a person skilled in the art.

We claim:

1. A spin-stabilized jungle penetration projectile comprising:

A. a first housing including a cylindrical shell having a rotating band, a rear cover, and a forward conical ogive;

B. an anti-personnel munition located in the rear end of said shell and comprising (1) a second housing containing a high explosive charge, (2) a detonator for said charge, and (3) a delay detonating charge contiguous to said detonator; and C. means for expelling said anti-personnel munition and said cover from said first housing, comprising:

1. a cup-shaped main casing mounted within said shell with its base forward and its side wall extending rearwardly and slidably engaging the outer periphery of said second housing, and having an axial bore in said base containing an explosive expelling charge exposed to the forward end of said munition for expelling the latter and also exposed to said delay detonating charge for initiation thereof;

2. means for initiating said propelling charge on impact of said projectile with a target comprising a second casing within said shell, between said main casing and said ogive and collapsible with said ogive on impact, an anvil axially mounted in said second casing, a forwardly-biased firing pin aligned with the longitudinal axis of said projectile, centrifugal weights biasedly disposed between said firing pin and said anvil prior to launching said projectile, a biased detonator held out of line with said longitudinal axis by said firing pin prior to launch, and a firing train composition connecting said biased detonator with the forward end of said expelling charge;

whereby, when said projectile is launched, the spin of said projectile causes said weights to move outward, releasing said firing pin to move toward said anvil and release said biased detonator, which then moves into firing position in line with said firing pin, ready for firing on impact.

2. The jungle penetration projectile of claim 1 wherein the collapsible casing is fabricated of a material selected from the group consisting of aluminum and plastic.

3. The jungle penetration projectile of claim 1 wherein the ogive is fabricated of a metal selected from the group consisting of aluminum, steel and alloys thereof.

4. The jungle penetration projectile of claim 1 wherein the second casing is of conical shape.

5. The jungle penetration projectile of claim 1 wherein the anvil is made of a material selected from the group consisting of brass, steel alloys and quartz.

6. The jungle penetration projectile of claim 1 wherein the biased detonator comprises an explosive selected from the group consisting of lead azide, lead styphnate and hexanitromannite.

7. The jungle penetration projectile of claim 1 wherein the firing train composition is an explosive selected from the group consisting of black powder, OCTOL and a pyrotechnic mixture of an oxidant and a metallic fuel.

8. The jungle penetration projectile of claim 1 wherein the expelling charge is an explosive selected from the group consisting of M9 propellant and black powder.

9. The jungle penetration projectile of claim 1 wherein the delay detonating charge is a material selected from the group consisting of black powder, a pyrotechnic material, and a mixture of RDX, lead azide and a delay composition.

10. The jungle penetration projectile of claim 1 wherein the munition explosive detonator is an explosive selected from the group consisting of lead azide and lead styphnate.

11. The jungle penetration projectile of claim 1 wherein the anti-personnel munition explosive charge is selected from the group consisting of RDX and HMX.

12. The jungle penetration projectile of claim 1 wherein the anti-personnel munition housing is made of a quilted hard metal selected from the group consisting of brass, steel and alloys thereof.

13. The jungle penetration projectile of claim 1 wherein the anti-personnel munition housing is spherical in shape.

14. The jungle penetration projectile of claim 1, wherein:

A. said anti-personnel munition housing seals the open end of said main casing and is threadedly attached to a cylindrical plug provided with an axial passage which communicates with said expelling charge and said high explosive charge and contains said charge detonator and said delay detonating charge, said cylindrical plug being releasably attached to the base of said main casing, thereby forming a closed annular chamber between the anti-personnel munition and the main casing; and B. said base of said main casing is provided with channels connecting said chamber with said explosive expelling charge, whereby when the expelling charge is initiated, the gases generated thereby pass through said channels to pressurize said chamber and expel the anti-personnel munition from said first housing.

* * * * *